US007185389B2

(12) United States Patent
Thomason et al.

(10) Patent No.: US 7,185,389 B2
(45) Date of Patent: Mar. 6, 2007

(54) UNIVERSAL WET/DRY VACUUM CART

(75) Inventors: Scott R. Thomason, Maple Heights, OH (US); Nicholas J. Mastandrea, Newbury, OH (US)

(73) Assignee: Great Lakes Engineering + Design, Inc., Solon, OH (US)

( * ) Notice: Subject to any disclaimer, the term of this patent is extended or adjusted under 35 U.S.C. 154(b) by 166 days.

(21) Appl. No.: 10/447,368

(22) Filed: May 29, 2003

(65) Prior Publication Data

US 2003/0229964 A1 Dec. 18, 2003

Related U.S. Application Data

(60) Provisional application No. 60/384,232, filed on May 30, 2002.

(51) Int. Cl.
*A47L 5/00* (2006.01)
*A47L 9/00* (2006.01)

(52) U.S. Cl. ..... 15/246.4; 15/353

(58) Field of Classification Search ..... 15/246, 15/246.2, 246.4, 327.1, 327.2, 327.6, 339, 15/340.1, 340.2
See application file for complete search history.

(56) References Cited

U.S. PATENT DOCUMENTS

| | | | | | |
|---|---|---|---|---|---|
| 564,013 | A * | 7/1896 | Furnas | 15/353 |
| 941,347 | A * | 11/1909 | Markstein | 15/343 |
| 1,096,743 | A * | 5/1914 | Noe | 15/350 |
| 1,461,173 | A * | 7/1923 | Bennett | 15/353 |
| 2,193,784 | A * | 3/1940 | Smith | 15/301 |
| 2,538,643 | A * | 1/1951 | Gregory | 56/13.1 |
| 2,668,977 | A * | 2/1954 | Reece | 15/246.4 |
| 2,673,366 | A * | 3/1954 | Johnson | 15/246.4 |
| 2,824,335 | A * | 2/1958 | Moffat | 15/345 |
| 2,876,484 | A * | 3/1959 | Wells | 15/246.4 |
| 2,985,905 | A * | 5/1961 | Caufield | 15/353 |
| 3,063,082 | A * | 11/1962 | Rosenberg | 15/327.2 |
| 3,105,339 | A * | 10/1963 | Pagel et al. | 56/13.1 |
| 3,290,716 | A * | 12/1966 | Cain | 15/353 |
| 3,358,316 | A * | 12/1967 | Okun | 15/352 |
| 3,903,565 | A * | 9/1975 | Hicks | 15/352 |
| 3,930,630 | A * | 1/1976 | Wulff | 248/129 |
| 4,006,512 | A * | 2/1977 | Saulson | 15/339 |
| 4,616,378 | A * | 10/1986 | Berfield et al. | 15/353 |
| 4,809,396 | A * | 3/1989 | Houser | 15/320 |
| 4,993,107 | A * | 2/1991 | Zoni | 15/352 |
| 5,354,347 | A * | 10/1994 | McCoy et al. | 96/330 |

* cited by examiner

*Primary Examiner*—Terrence R. Till
(74) *Attorney, Agent, or Firm*—Great Lakes Engineering + Design, Inc.; Roger D. Emerson; Timothy D. Bennett

(57) ABSTRACT

A universal cart is provided that receives a wet/dry vacuum and converts the vacuum into an upright walk behind cleaning device. The cart provides a handle attached to a mobile base. A switch is provided on the handle that can receive the electrical plug from the wet/dry vacuum and selectively turn the vacuum on and off via the switch.

7 Claims, 6 Drawing Sheets

UNIVERSAL WET/DRY VACUUM CART

This application claims priority to U.S. Provisional patent application Ser. No. 60/384,232 filed May 30, 2002 for a Universal Wet/Dry Vacuum Cart.

1. BACKGROUND OF THE INVENTION

A. Field of Invention

This invention describes a device that converts an ordinary wet/dry utility vacuum into a walk behind upright vacuum tool.

B. Description of the Related Art

It is well known in the art to use a wet/dry vacuum to clean various areas of a house or business. Typically wet/dry vacuums include rollers that allow the device to be rolled along behind the operator during use. This may require the operator to kneel down, for example, if they are cleaning an area of the floor.

What is needed is a universal cart for placing a wet/dry vacuum on that allows the wet/dry vacuum to be used as an upright walk behind cleaning device.

II. SUMMARY OF THE INVENTION

This device is useful for using the wet/dry vacuum to clean debris from various surfaces such as driveways, garage floors, basement floors, etc. One method is to supply a separate cart that the wet/dry vacuum can be attached to. The cart has a nozzle protruding down from any direction of the cart. This nozzle will contact the ground surface or have close proximity to the ground surface. The input hose of the wet/dry vacuum is connected to the nozzle so that the suction from the vacuum is routed through the nozzle. The exhaust of the vacuum can also be routed through the nozzle and be used as a blower. The cart also has a handle from which to maneuver the cart.

Another method is to attach a ground-contacting nozzle and a handle directly to the tank or base of a wet/dry vacuum.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
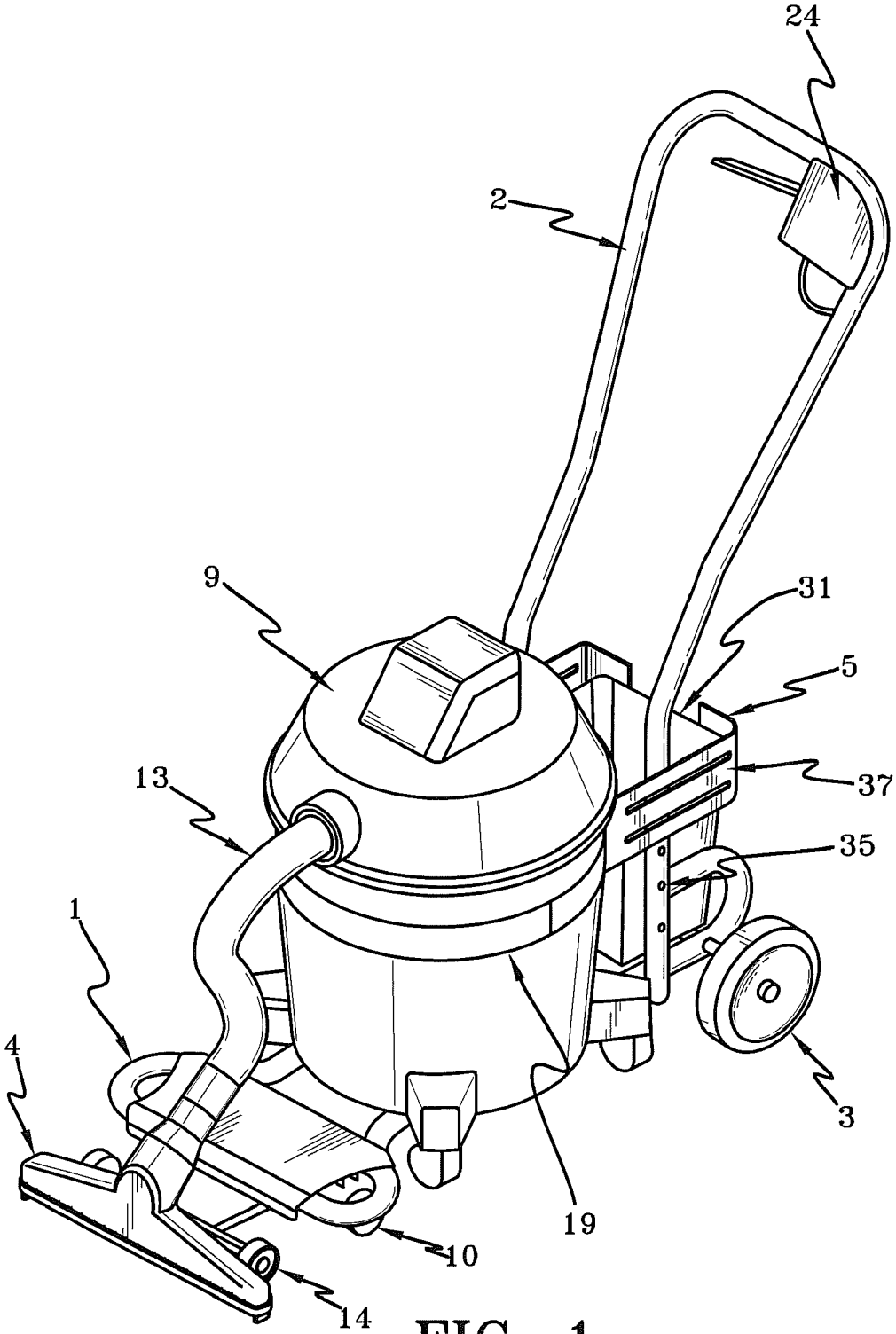
FIG. 1 is a perspective view of a cart with an attached vacuum.
Figure 2:
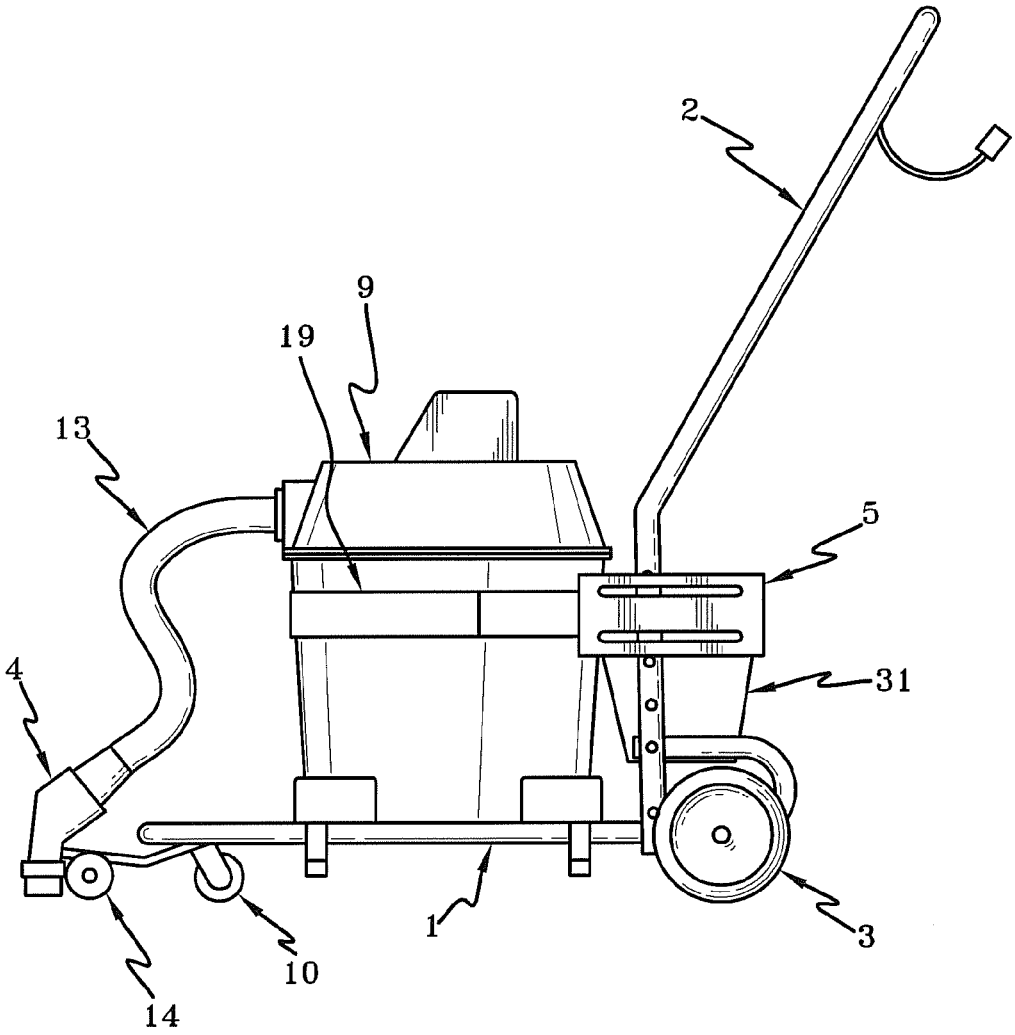
FIG. 2 is a side view of the cart with an attached vacuum.
Figure 3:
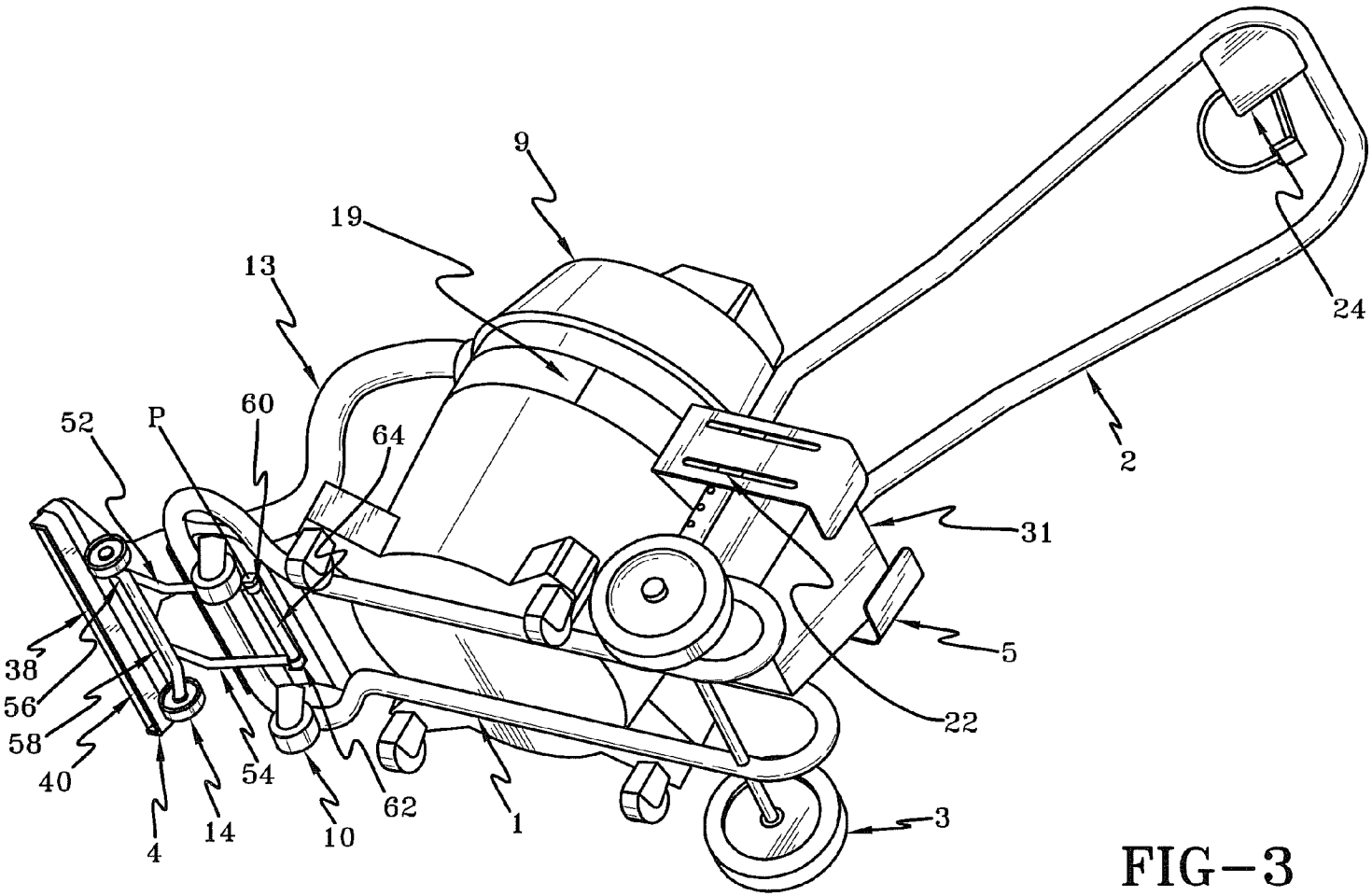
FIG. 3 is a perspective view of the underside of the cart with an attached vacuum.

Referring now to the drawings wherein the showings are for purposes of illustrating a preferred embodiment of the invention only and not for purposes of limiting the same, FIGS. 1, 2, & 3 show views of the complete cart assembly. The cart includes a base 1 that acts as a support platform to hold the vacuum 9. The base 1 is supported on the ground by rear wheels 3 and front caster wheel(s) 10. The nozzle 4 may pivot on the front of the base about pivot axis P described below. This pivoting action allows the nozzle 4 to adjust over uneven ground surfaces and still remain in contact with the ground surface.

With reference to FIG. 3, the pivoting action of the nozzle 4 and the pivot axis P will be further described. As shown in FIG. 3, at least a first extension arm 52, and preferably at least first and second extension arms 52, 54 may extend rearwardly from the nozzle 4 toward the base 1. The first ends 56, 58 of the first and second extension arms 52, 54 may be attached to the nozzle 4, such as by welding, mechanical fasteners, or any other means of attachment, selected with sound engineering judgment. The second ends 60, 62 of the first and second extension arms 52, 54 may be pivotally, operatively connected to a substantially horizontal cross member 64 disposed toward the front of the base 1 along the pivot axis P.

Figure 4:
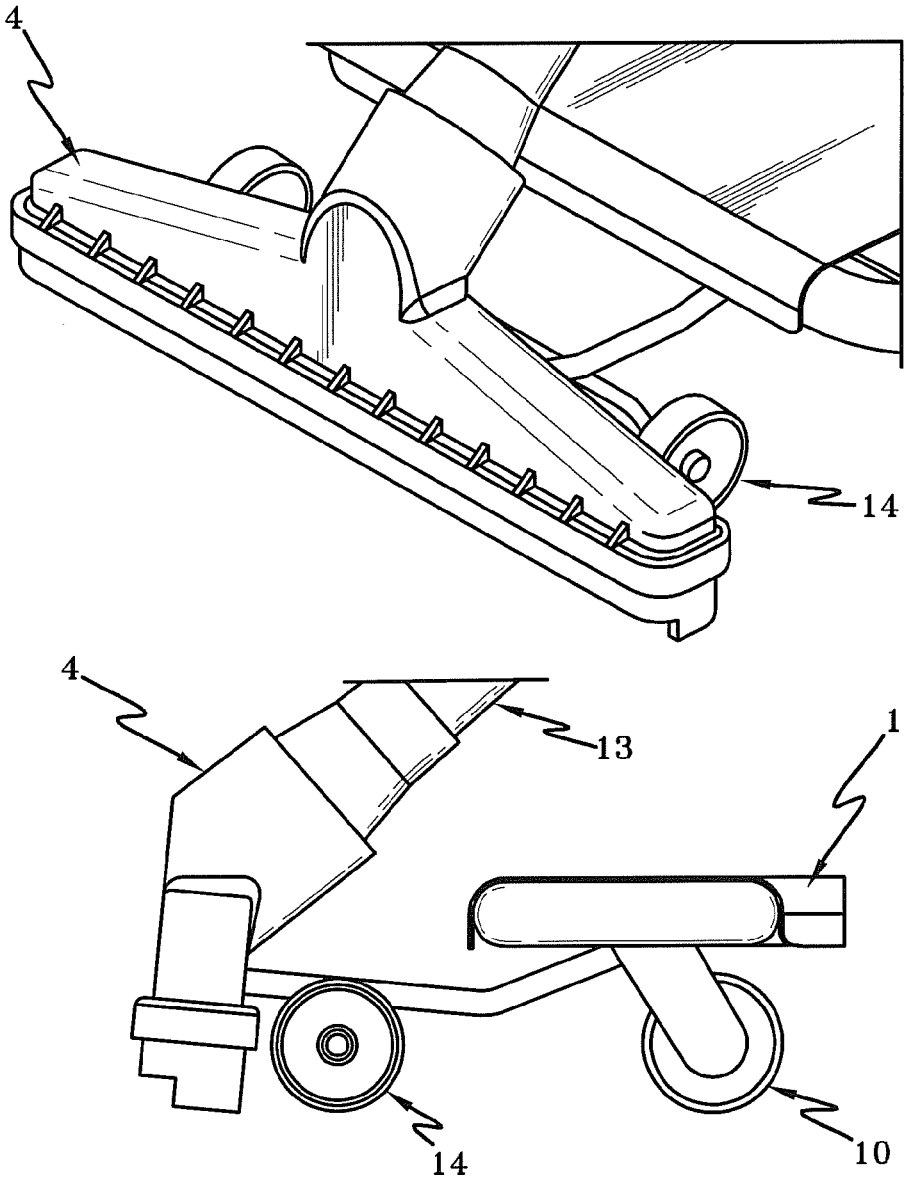
FIG. 4 is a close up view of the cart with an attached vacuum.
Figure 5:
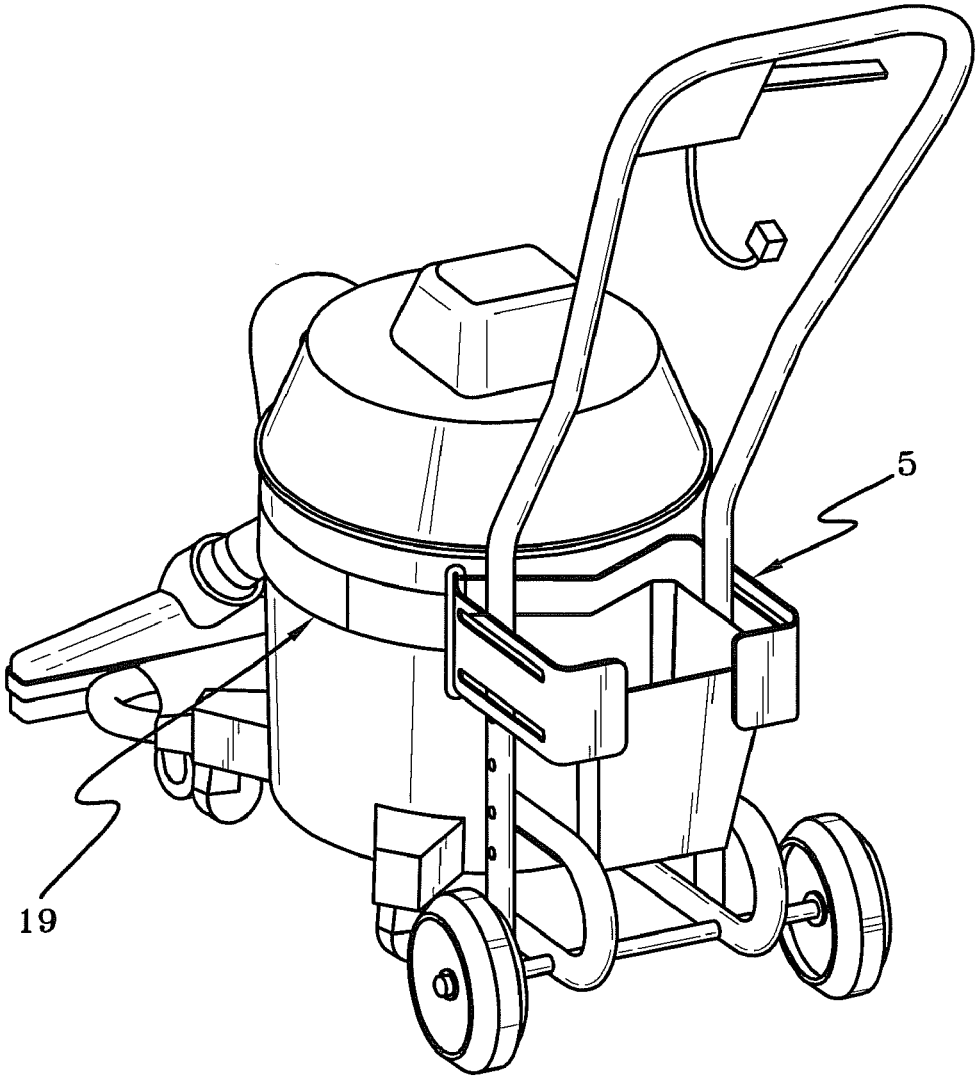
FIG. 5 is a perspective view of the rear side cart with an attached vacuum.

Alternately, the nozzle 4 may slide up and down or side-to-side, as opposed to pivoting, in a slotted groove with respect to the base 1. A hose 13 may be included that connects between the nozzle 4 and the vacuum 9. The nozzle shown in the figures may have two small wheels 14 attached on its outboard sides. The wheels 14 may be positioned on the outbound side of the pivot axis P and be positioned between the pivot axis P and the nozzle 4. However, in an alternate embodiment, the nozzle 4 may contact the ground directly without the use of any wheels. The wheels 14 act as the main contact with the ground. Wheels 14 can be caster or slide or some other means of supporting said nozzle 4. The front of the nozzle 4 is open and the sides and back of the nozzle 4 may be sealed with brushes, seals or other material used to seal side surfaces. The brushes also help to "sweep" the debris from the ground surface. In one embodiment, the brushes may be rotating brushing powered independently by an actuator and power source or the brushes may be connected in such a manner as to freely spin about an axel member. Details of the nozzle 4 can be seen in FIG. 4. A handle 2 is fixed to the base 1. The handle 2 is used as the means of maneuvering the cart assembly and is design to facilitate folding down for storage.

With reference to all of the Figures, the nozzle 4 may include alternate attachments. One such attachment may be a wiper blade 38 to direct or channel liquid on the surface being cleaned. The wiper blade 38 may be constructed from a flexible material. The wiper blade 38 may also be oriented at any angle with respect to the nozzle 4 as chosen with sound engineering judgment. A liquid cleaning dispensing attachment may be juxtaposed to the wiper blade 38 for use in selectively dispensing a cleaning solution during the cleaning process. Alternately, the nozzle 4 may include a magnetic member 40 for use in picking up debris having Ferrous properties such as Ferrous metal debris. The magnetic member 40 may be positioned close to the ground on the underside of the nozzle 4. Any magnetic strength of magnetic member 40 may be chosen with sound engineering judgment.

FIGS. 1 and 3 also show an optional electrical hand switch 24. The power cord from the vacuum may be plugged into the hand switch 24. Also plugged to the hand switch 24 is the extension cord, or other electrical conductive device, from the electrical outlet. The hand switch 24 is used as a convenient way to turn the vacuum on and off without reaching down to use the main power switch supplied with the vacuum. Any method of providing a switching means, chosen with sound engineering judgment, for turning power on and off at the handle 2 may be incorporated.

FIGS. 1, 2, and 3 also show an adjustable stop bracket 5. This bracket 5 is used as a stop to support the back of the vacuum tank. An adjustable strap 19 may be used to secure and hold the vacuum tank against the adjustable bracket 5. This bracket is mounted to the handles 2 and can be adjusted vertically using a pattern of holes 35 supplied in the handle. The bracket 5 can also be adjusted horizontally using the slotted mounting holes 37 in the bracket. An alternate method to support the vacuum tank is with an adjustable stop mounted to the base. The adjustable strap 19 is used to secure the vacuum tank against the adjustable stop. These brackets and straps are adjustable to support a wide variety of wet/dry vacuums consisting of different shapes and sizes.

FIGS. 1, 2, and 3 also show an optional attachment bag 31 with multiple ways of attachment. Upon mounting the vacuum to the cart, the optional attachment bag 31 would allow for an alternative method of storing vacuum attachments. This bag could also be used for holding larger debris items.

Figure 6:
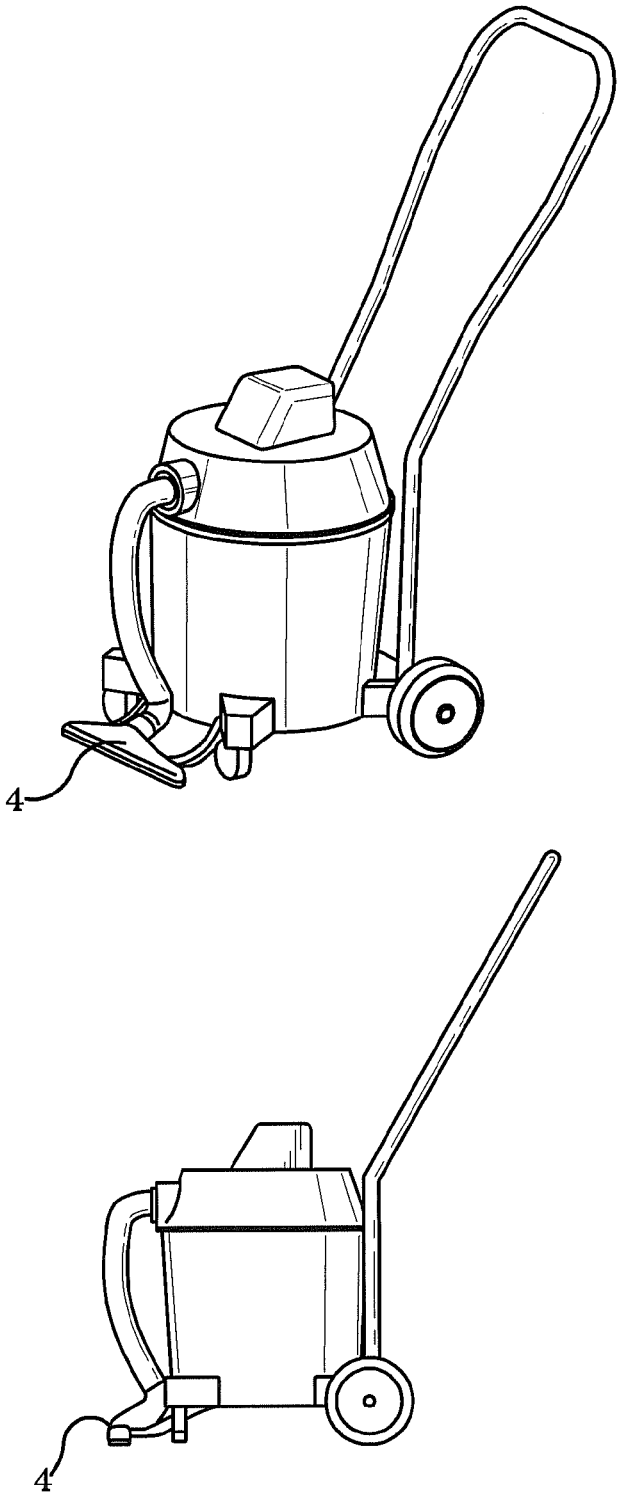
FIG. 6 is a perspective view of an alternate embodiment of the subject invention showing a wet/dry vacuum having fixed rear wheels and front wheels.

Most previous wet/dry vacuums used a tank with four small caster wheels mounted the bottom of the tank. Some newer designs have large non-swiveling rear wheels and a handle mounted to the tank. An alternate method for this invention is to mount a pivoting, ground-contacting nozzle to the front of a wet/dry vacuum such as previously mentioned. FIG. 6 shows the pivoting nozzle in this configuration.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

We claim:

1. A cart for use in making a wet/dry vacuum function as an upright, walk-behind cleaning device, the cart comprising:

a base having first and second ends, the base adapted as a support platform for use in receiving an associated wet/dry vacuum;

at least a first ground engaging wheel operatively connected to the first end of the base;

at least a second ground engaging wheel operatively connected to the second end of the base;

a handle extending from the second end of the base;

a nozzle pivotally, operatively connected to the base at a pivot axis, the nozzle having a receiving portion for use in receiving an associated vacuum hose of the associated wet/dry vacuum, the nozzle being disposed proximate to the ground surface;

securing means operatively connected to the handle for use in securing the associated wet/dry vacuum to the base;

wherein the securing means includes a stop bracket selectively adjustable in a direction selected from the group consisting of horizontally and vertically and at least a third ground engaging wheel operatively attached to the nozzle, the third ground engaging wheel positioned between the nozzle and the pivot axis.

2. The device of claim 1 wherein the securing means includes a strap.

3. The device of claim 2, wherein the strap is adjustable.

4. The device of claim 1, further comprising:

an electrical hand switch operatively attached to the handle, the electrical hand switch being adapted to receive a plug from the associated wet/dry vacuum's power cord and to selectively operatively communicate power from an associated electrical power source to the associated wet/dry vacuum through the electrical power cord of the associated wet/dry vacuum.

5. The device of claim 1, further comprising:

at least a first brush operatively connected to the nozzle, wherein the brush abuts the ground surface for use in cleaning the ground surface.

6. The device of claim 5, further comprising:

a magnetic member operatively attached to the nozzle.

7. The device of claim 1, wherein the third ground engaging wheel is positioned outbound from the pivot axis and between the pivot axis and the nozzle.

* * * * *